US005897966A

United States Patent [19]

Grossklaus, Jr. et al.

[11] Patent Number: 5,897,966

[45] Date of Patent: Apr. 27, 1999

[54] HIGH TEMPERATURE ALLOY ARTICLE WITH A DISCRETE PROTECTIVE COATING AND METHOD FOR MAKING

[75] Inventors: Warren D. Grossklaus, Jr., West Chester; Richard R. Worthing, Jr., Cincinnati, both of Ohio

[73] Assignee: General Electric Company, Cincinnati, Ohio

[21] Appl. No.: 08/606,903

[22] Filed: Feb. 26, 1996

[51] Int. Cl.[6] ..... B32B 15/10; C22F 1/09

[52] U.S. Cl. ..... 428/652; 428/668; 428/670; 428/680; 148/535

[58] Field of Search ..... 428/610, 652, 428/670, 941, 668, 680; 427/250, 252; 148/535

[56] References Cited

U.S. PATENT DOCUMENTS

| | | | |
|---|---|---|---|
| 3,544,348 | 12/1970 | Boone et al. | 117/2 |
| 3,598,638 | 8/1971 | Levine | 117/107.2 P |
| 3,667,985 | 6/1972 | Levine et al. | 117/22 |
| 3,692,554 | 9/1972 | Bungardt et al. | 117/22 |
| 3,819,338 | 6/1974 | Bungardt et al. | 29/194 |
| 3,961,910 | 6/1976 | Baladjanian et al. | 29/197 |
| 3,979,273 | 9/1976 | Panzera et al. | 204/192 |
| 3,999,956 | 12/1976 | Stueber et al. | 29/194 |
| 4,004,047 | 1/1977 | Grisik | 427/142 |
| 4,070,507 | 1/1978 | Stueber et al. | 427/252 |
| 4,123,594 | 10/1978 | Chang | 428/651 |
| 4,123,595 | 10/1978 | Chang | 428/667 |
| 4,176,433 | 12/1979 | Lee et al. | 29/156.8 B |
| 4,501,776 | 2/1985 | Shankar | 427/253 |
| 4,530,885 | 7/1985 | Restall | 428/670 |
| 4,656,099 | 4/1987 | Sievers | 428/610 |
| 4,962,005 | 10/1990 | Alperine et al. | 428/670 |
| 5,292,594 | 3/1994 | Liburdi et al. | 428/650 |
| 5,658,614 | 8/1997 | Basta et al. | 427/253 |

FOREIGN PATENT DOCUMENTS

| | | |
|---|---|---|
| 0 731 187 A1 | 9/1996 | European Pat. Off. . |
| 1 210 026 | 10/1970 | United Kingdom . |
| 1 545 305 | 5/1979 | United Kingdom . |
| 2 129 017 | 5/1984 | United Kingdom . |
| 2 130 249 | 5/1984 | United Kingdom . |
| 96/13622 | 5/1996 | WIPO . |

OTHER PUBLICATIONS

Abstract—Derwent Publications database—Samsung Aerospace Ind Co "Coating Platinum Aluminide Film Nickel Base Superalloy Polish Clean Surface Electroplating Platinum Film Diffusion Nickel Platinum Layer Heat Treat" Inventor: W Kang XP 002050840.

Article entitled "High Temperature Stability of Pack Aluminide Coatings on IN738LC" by SP Cooper and A Strang, Central Meallurgical Laboratories pp. –250–260.

*Primary Examiner*—Paul Thibodeau
*Assistant Examiner*—Holly C Rickman
*Attorney, Agent, or Firm*—Andrew C. Hess; David L. Narciso

[57] ABSTRACT

An environmental resistant spot type coating is provided on a selected, discrete surface area of a high temperature operating article, by applying to the area a layer of at least one of the elements selected from Pt, Rh and Pd, and preferably Pt, to a thickness of about 0.0002" to less than 0.0006" and an average distribution of at least about 0.07 grams per square inch. The layer is heated at about 1800–2050° F. for about ½–4 hours to diffuse the element with the surface area. Then the layer is aluminided to provide an average total coating thickness of about 0.001–0.005". The article provided includes an environmental resistant additive coating diffused with the selected discrete area. The coating comprises an outer portion of at least about 17 wt. % of the selected element, and an aluminide of the surface area or substrate. In one form, the outer portion is a two phase outer portion: a first phase of an aluminide of the selected element at a content of at least about 40 wt. % interspersed with a second phase comprising an aluminide in which Al is at least about 20 wt. %. Between the outer portion and the surface area is an inner portion which is a diffusion zone comprising diffused selected element along with an aluminide and/or elements diffused from the surface area.

5 Claims, No Drawings

HIGH TEMPERATURE ALLOY ARTICLE WITH A DISCRETE PROTECTIVE COATING AND METHOD FOR MAKING

FIELD OF THE INVENTION

This invention relates to high temperature Ni base superalloy articles coated for environmental protection and, more particularly, to such articles which include at least one discrete, selected article surface area having an additive environmental protective coating.

BACKGROUND OF THE INVENTION

During the operation of high temperature articles, such as components of gas turbine engines, highly corrosive and oxidizing conditions can be experienced by exposed article surfaces. Therefore, development of the gas turbine art has included development of a variety of coatings resistant to such adverse conditions. Such known coatings include commercially available forms of Codep coating aluminiding, examples of which are included in such U.S. patents as U.S. Pat. Nos. 3,598,638—Levine (issued Aug. 10, 1971) and 3,667,985—Levine et al (issued Jun. 6, 1972). Associated with general aluminiding is a localized aluminiding through a patch-type coating such as is described in U.S. Pat. No. 4,004,047—Grisik, issued Jan. 18, 1977.

Other forms of high temperature coatings used for environmental protection include combinations of metals selected from the platinum group of metals, particularly Pt, Rh and Pd, along with aluminiding. Forms of this combination of coatings are described in U.S. Pat. Nos. 3,819,338—Bungardt et al (issued Jun. 25, 1974) and 3,979,273—Panzera et al (issued Sep. 7, 1976).

The disclosures of each of the above identified patents hereby are incorporated herein by reference.

Coatings of various types, including an overall platinum aluminide coating, have been reported and used as protective coatings for high temperature operating gas turbine engine components such as a high pressure turbine blade (HPTB). However, certain problems have been recognized during manufacture and/or use of such articles. For example, during the service life of a typical HPTB, several partial and at least one full repair generally will be required to extend the useful life of such a component, which originally is relatively expensive to manufacture. Complicating such later repairs can be the application, in original manufacture of the article, of an environmental protective coating, generally referred to as a thermal barrier coating, and based on ceramic type materials such as zirconia, generally stabilized with such materials as yttria. Being ceramic base, such coating has a greater tendency than would a metal base coating to be brittle and to spall if processed subsequently, such as in repair, after initial coating. Therefore, repair of discrete surface areas of a thermal barrier coated article is more difficult. In all cases, a reliable spot-type or discrete surface coating is needed for the repair or to enhance the environmental resistance of localized discrete selected surfaces of a high temperature operating article to which has been applied a surface environmental protective coating.

SUMMARY OF THE INVENTION

In one form, the present invention is a method for providing an environmental resistant coating on a selected discrete surface area of an article. To avoid coating of surfaces adjacent the selected area to be coated, other article surface areas adjacent the selected discrete surface area usually are masked, particularly with a material which is substantially nonreactive with the article surface. There is applied to the selected discrete surface area a first coating portion comprising at least one element selected from Pt, Rh and Pd to an average thickness in the range of about 0.0002" to less than 0.0006" and an average element distribution of at least about 0.07 grams per square inch. The first portion is heated in a non-oxidizing atmosphere at a temperature in the range of about 1800–2050° F. for about ½–4 hours to diffuse the selected element into the discrete surface area. Then the first portion is aluminided to provide on the selected surface area an environmental resistant coating including an outer portion comprising nickel aluminide along with the selected element, preferably Pt, diffused therein in a content of at least about 17 wt. %. In a two phase form of outer portion, as applied, the selected element exists in a first phase as an aluminide of the selected element dispersed with a second phase of nickel aluminide, the content of the selected element in the first phase being at least about 40 wt. %. An inner portion of the coating comprises diffused selected element, such as platinum, in nickel aluminide and elements diffused from the selected surface area. Provided is a coating with an average total thickness in the range of about 0.001–0.005".

In another form, the present invention provides an article having a substrate, for example a high temperature alloy such as a Ni base superalloy substrate or a substrate of a previously applied environmental coating, and at least one discrete surface portion diffused with the substrate and which includes an environmental resistant additive coating on the discrete surface portion. The coating comprises an outer portion of nickel aluminide with at least one of the metals Pt, Rh and Pd diffused therein, in one form as a separate phase. Such two phase outer portion form includes a first phase of an aluminide of at least one of the metals Pt, Rh and Pd, (preferably Pt) at a content of at least about 40 wt. %, interspersed with a second phase of nickel aluminide, and the Al content of the outer portion is at least about 20 wt. %. The coating also includes an inner portion, which is a diffusion zone between the outer portion and the substrate, the inner portion comprising diffused selected element, such as Pt, along with nickel aluminide and elements diffused from the outer portion of the substrate.

DESCRIPTION OF THE PREFERRED EMBODIMENTS

Two general instances where a discrete additive, additional surface coating having high temperature environmental resistance is desired are during partial or "mini" repair of portions of an article, as well as for enhancing, during manufacture or repair, the protection of one or more selected article surfaces particularly exposed to strenuous high temperature operating conditions. Examples of such selected article surfaces can include surfaces experiencing high erosion, oxidation, corrosion or potential rub such as turbine blade tips, leading or trailing edges, or platform surfaces.

Modern gas turbine engine turbine blades frequently include a platinum aluminide coating on the surface exposed to the operating environment. To replace the entire coating when only one or more discrete surface areas require repair is costly both in material and labor. The present invention provides a cost effective, discrete, additive protective coating for selected, discrete surfaces of an article.

The additive coating of the present invention includes inner and outer portions having elemental content balanced to provide desired environmental protection for strenuous operating conditions experienced in a gas turbine engine turbine section, yet, as a spot or discrete area repair, of a thickness consistent with aerodynamic surface requirements and which resists spalling such as of thermal barrier coatings adjacent the complex additive coating. During evaluation of the present invention it was recognized that such a desirable coating could be provided by a careful balance of the amount of elemental content, and distribution and thickness of each applied layer or portion, in combination with a heat treatment which developed the structure of the protective coating.

In one article form of the present invention, the discrete additive coating includes an outer portion comprising nickel aluminide in which there is diffused at least one element selected from Pt, Rh and Pd (preferably Pt) in which the selected element is at least about 17 wt. %. In another form, the outer portion, as applied, comprises a two interspersed phase outer portion: a first phase of an aluminide of the platinum group elements, preferably Pt, in which such element content is at least about 40 wt. % to provide adequate protection when diffused with other ingredients of the coating, and a second phase of nickel aluminide. The Al content is at least about 20 wt. % for that same reason. Combined with either form of the outer portion is an inner portion, also developed during subsequent heat treatment, which is a diffusion zone between the outer portion and the substrate and comprising diffused selected element, such as Pt, along with nickel aluminide and elements diffused from the substrate.

In the method form of the invention, after selecting one or more discrete surface areas to which the additive coating is to be applied and cleaning and masking adjacent areas with a nonreactive masking material, there is applied a first coating portion of an element selected from the platinum group such as Pt, Rh and Pd. In this example, the article to be coated was a gas turbine engine turbine blade made of a commercially available Ni base superalloy sometimes referred to as René 80 alloy, a form of which is described in U.S. Pat. No. 3,615,376—Ross, issued Oct. 26, 1971. A selected surface area of the blade was cleaned by grit blasting away the existing coating in that area to expose the Ni base superalloy as the substrate. Adjacent areas were masked with plating tape. During evaluation of the present invention, the element Pt was used and was deposited by standard, commercial electroplating. However, a variety of methods for Pt application are known and include, in addition to electroplating, brush or spot plating, electrospark deposition, ion plating, sputtering, etc. Forms of Pt deposition are described in the above incorporated Bungardt et al and Panzera et al patents. However, according to the present method, it was recognized that, in order to provide a discrete, spot type coating with adequate environmental resistance, the Pt when applied must be at an average thickness in the range of at least about 0.0002" for adequate protection but less than about 0.0006" at which level and above a resulting coating of platinum aluminide was recognized to become embrittled. In addition, in order to provide uniform surface protection, the average Pt distribution must be at least about 0.07 grams per square inch.

In the present invention, after Pt deposition, the first portion, comprising the Pt in this example, was heated in a non-oxidizing atmosphere, including vacuum or inert gases, at a temperature in the range of about 1800–2050° F. for about ½ to 4 hours to diffuse the Pt into the discrete surface area. In this example, the Pt thickness was about 0.0002–0.0004" as deposited and the heating was in a vacuum at a temperature in the range of about 1800–1950° F. for ½–2 hours to diffuse the Pt with the substrate.

The selected, discrete surface portion thus coated with the platinum group metal such as Pt was aluminided by a standard commercial aluminiding process such as the pack cementation type process described in the above incorporated U.S. Pat. No. 3,667,985—Levine et al, by the process in which only the vapor contacts the surface as in the above incorporated U.S. Pat. No. 3,598,638—Levine or by a process in which a slurry of an aluminiding powder contacts the surface. However, according to the present method, the aluminiding must be conducted to provide at least about 17 wt. % Pt in the outer portion, and at least about 40 wt. % in the two phase outer portion form, for adequate protection in the spot type coating and to provide an average total coating thickness of about 0.001–0.005" to avoid cracking or spalling of the applied discrete coating.

In this example, aluminiding was conducted while heating in a non-oxidizing atmosphere at a temperature in the range of about 1850–2050° F. for about 1–4 hours, to diffuse the portions and to provide the structure of the coating of the present invention. However, some forms of commercial aluminiding can be conducted at lower temperatures without such heat treatment. When aluminiding was conducted according to the pack-type process in which the article is immersed in an aluminiding powder pack, generally the above described two phase structure outer portion resulted from that process. In such an outer portion, it was recognized that the Pt content in the platinum aluminide of the first phase outer layer must be at least about 40 wt. %. However, when the above described single phase outer portion is produced, such as when only the aluminiding vapor contacts the substrate, it was recognized that Pt in the range of about 17–25 wt. % can provide the final coating with adequate environmental resistance. The Al content should be at least about 20 wt. % for the same reason.

Resulting from practice of the above described method of the present invention was an environmental resistant additive coating on a selected discrete surface portion of an article. From the above examples of the present method, the coating comprised an outer portion and an inner portion as described above. In one form, the outer portion included two phases: a first phase of platinum aluminide, appearing as a relatively light phase in a photomicrograph, with a Pt content of at least about 40 wt. %, dispersed with a second phase of nickel aluminide, appearing as a relatively dark phase in a photomicrograph, preferably in about equal volume with the first phase and with an Al content of at least about 20 wt. %. The inner portion was a diffusion zone between the Ni base superalloy substrate and comprised diffused platinum, nickel aluminide and elements diffused from the substrate. The average total coating thickness was in the range of about 0.001–0.005". In another form, the outer portion was a single phase structure comprising nickel aluminide in which was diffused at least about 17 wt. % Pt.

The present invention has been described in connection with various embodiments, examples and combinations. However, it will be recognized and understood by those skilled in the arts involved that this invention is capable of a variety of modifications, variations and amplifications without departing from its scope as defined in the appended claims.

We claim:

1. In a method for providing an environmental resistant coating on a selected discrete Ni base superalloy surface area of an article in which method a first coating portion comprising at least one element selected from the group consisting of Pt, Rh, and Pd is applied to the discrete surface area; the first portion is heated in a non-oxidizing atmosphere to diffuse the at least one element selected from the group consisting of Pt, Rh and Pd with the discrete surface area; after which the first portion is aluminided to provide on the selected surface area an environmental resistant coating including an outer portion, and an inner portion which is a diffusion zone comprising an aluminide of at least one element diffused from the surface area, the method comprising the combination of:

applying the at least one element selected to the discrete surface area at an average selected element distribution of at least 0.07 grams per square inch and to an average thickness in the range of about 0.0002" to less than 0.0006";

heating the first portion to diffuse the at least one element selected at a temperature in the range of 1800–2050° F. for about ½–4 hours; and, aluminiding to provide the coating with the outer portion and the inner portion, so that the outer portion comprises the at least one element selected at a content of at least about 17 wt %, and the inner portion comprises the at least one element selected in addition to the aluminide of at least one element diffused from the surface area, the coating having an average thickness in the range of about 0.001–0.005";

the aluminiding including:

heating at a temperature in the range of about 1850–2050° F. for about 1–4 hours to provide an inner diffusion portion and a two phase outer portion, the two phase outer portion including:

a) a first phase of an aluminide of at least one element selected from the group consisting of Pt, Rh and Pd in which the at least one element selected content is at least about 40 wt. %, interspersed with b) a second phase of an aluminide in which the Al content is at least about 20 wt %; and, the inner portion is a diffusion zone between the outer portion and the surface area and comprises the at least one element selected, nickel aluminide and elements diffused from the surface area.

2. The method of claim 1 in which:

the at least one element selected is Pt;

the Pt is applied to a thickness in the range of about 0.0002–0.0004"; and, the first portion is heated at a temperature in the range of about 1800–1950° F. for about ½–2 hours.

3. An article having a surface area which is a Ni base superalloy and at least one discrete surface portion diffused with the surface area, the discrete surface portion including an environmental resistant discrete coating comprising:

an outer portion comprising an aluminide of at least one element diffused from the surface area and at least about 17 wt. % of at least one element selected from the group consisting of Pt, Rh and Pd diffused therein, and, an inner portion which is a diffusion zone between the outer portion and the surface area comprising at least one diffused element selected from the group consisting of Pt, Rh and Pd along with an aluminide of at least one element diffused from the surface area;

the outer portion of the coating being a single phase outer portion comprising nickel aluminide, in which the aluminum content is at least about 20 wt. %, and about 17–25 wt % of the at least one element selected from the group consisting of Pt, Rh and Pd diffused in the nickel aluminide;

the coating having an average total thickness in the range of about 0.001–0.005".

4. An article having a surface area which is a Ni base superalloy and at least one discrete surface portion diffused with the surface area, the discrete surface portion including an environmental resistant discrete coating comprising:

an outer portion comprising an aluminide of at least one element diffused from the surface area and at least about 17 wt. % of at least one element selected from the group consisting of Pt, Rh and Pd diffused therein, and, an inner portion which is a diffusion zone between the outer portion and the surface area comprising at least one diffused element selected from the group consisting of Pt, Rh and Pd alone with an aluminide of at least one element diffused from the surface area;

the outer portion of the coating being a two phase outer portion including:

a) a first phase of an aluminide of at least one element selected from the group consisting of Pt, Rh and Pd in which the at least one element selected content is at least about 40 wt. %, interspersed with b) a second phase of nickel aluminide in which the Al content is at least about 20 wt. %;

the coating having an average total thickness in the range of about 0.001–0.005".

5. The article of claim 4 in which:

the at least one element selected is Pt; and the aluminide is platinum aluminide.

* * * * *